US007226364B2

(12) United States Patent
Helmstetter

(10) Patent No.: US 7,226,364 B2
(45) **Date of Patent: *Jun. 5, 2007**

(54) METHOD FOR FITTING GOLF CLUBS TO A GOLFER

(75) Inventor: Richard C. Helmstetter, Rancho Santa Fe, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/160,579

(22) Filed: Jun. 29, 2005

(65) Prior Publication Data

US 2007/0004527 A1 Jan. 4, 2007

(51) Int. Cl.
*A63B 53/02* (2006.01)

(52) U.S. Cl. ..... 473/307; 473/308; 473/309; 473/312; 473/345

(58) Field of Classification Search ..... 473/309–310, 473/288, 307, 298–299
See application file for complete search history.

(56) References Cited

U.S. PATENT DOCUMENTS

| | | | | |
|---|---|---|---|---|
| 2,282,614 | A * | 5/1942 | Smith | 473/310 |
| 4,597,577 | A * | 7/1986 | Lamanna | 473/307 |
| 4,948,132 | A | 8/1990 | Wharton | |
| 5,039,098 | A * | 8/1991 | Pelz | 473/306 |
| 5,133,553 | A | 7/1992 | Divnick | |
| 5,184,819 | A | 2/1993 | Desbiolles | |
| 5,513,844 | A | 5/1996 | Ashcraft et al. | |
| 5,527,034 | A | 6/1996 | Ashcraft et al. | |
| 5,716,289 | A * | 2/1998 | Okoneski | 473/297 |
| 5,722,901 | A | 3/1998 | Barron et al. | |
| 5,797,806 | A * | 8/1998 | Butler | 473/310 |
| 5,851,155 | A | 12/1998 | Wood et al. | |
| 5,863,260 | A | 1/1999 | Butler, Jr. et al. | |
| 5,885,170 | A | 3/1999 | Takeda | |
| 5,951,411 | A | 9/1999 | Wood et al. | |
| 6,149,533 | A | 11/2000 | Finn | |
| 6,273,828 | B1 | 8/2001 | Wood et al. | |
| 6,514,154 | B1 | 2/2003 | Finn | |
| 6,769,996 | B2 | 8/2004 | Tseng | |
| 7,017,252 | B2 * | 3/2006 | Lenhof et al. | 29/464 |
| 7,115,046 | B1 * | 10/2006 | Evans | 473/307 |
| 2001/0007835 | A1 * | 7/2001 | Baron | 473/305 |
| 2004/0018887 | A1 * | 1/2004 | Burrows | 473/307 |

* cited by examiner

*Primary Examiner*—Stephen Blau
(74) *Attorney, Agent, or Firm*—Micheal A. Catania; Elaine H. Lo

(57) ABSTRACT

A method (500) for fitting a golf club to a golfer is disclosed herein. The method includes having a golfer hit a test golf club. If the test golf club is preferred, a final golf club is formed that matches the test golf club. Preferably, the final golf club matches the following parameters of the test golf club: volume, mass, mass location, inertial values, center of gravity location, material composition and shape. In a preferred embodiment, a test golf club with an interchangeable shaft is utilized with the method.

11 Claims, 7 Drawing Sheets

FIG. 1
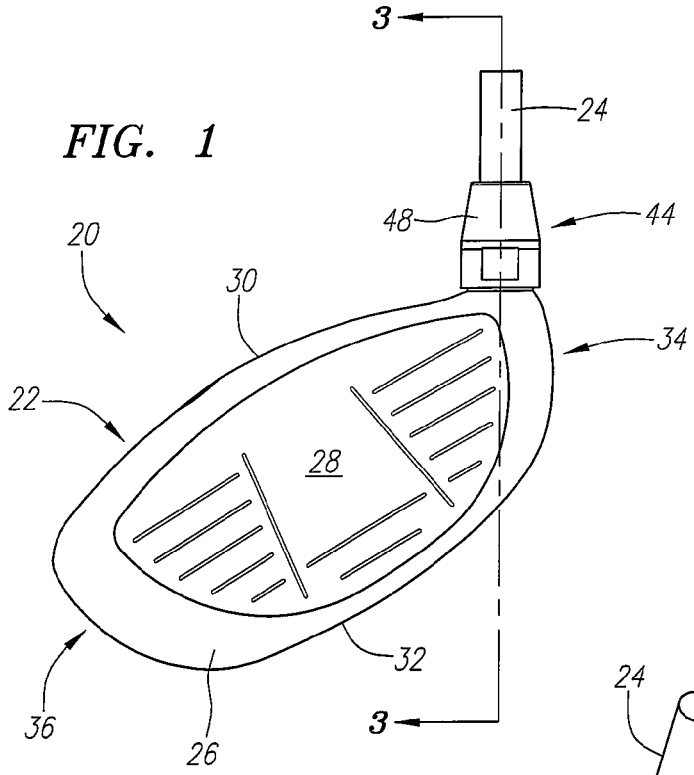
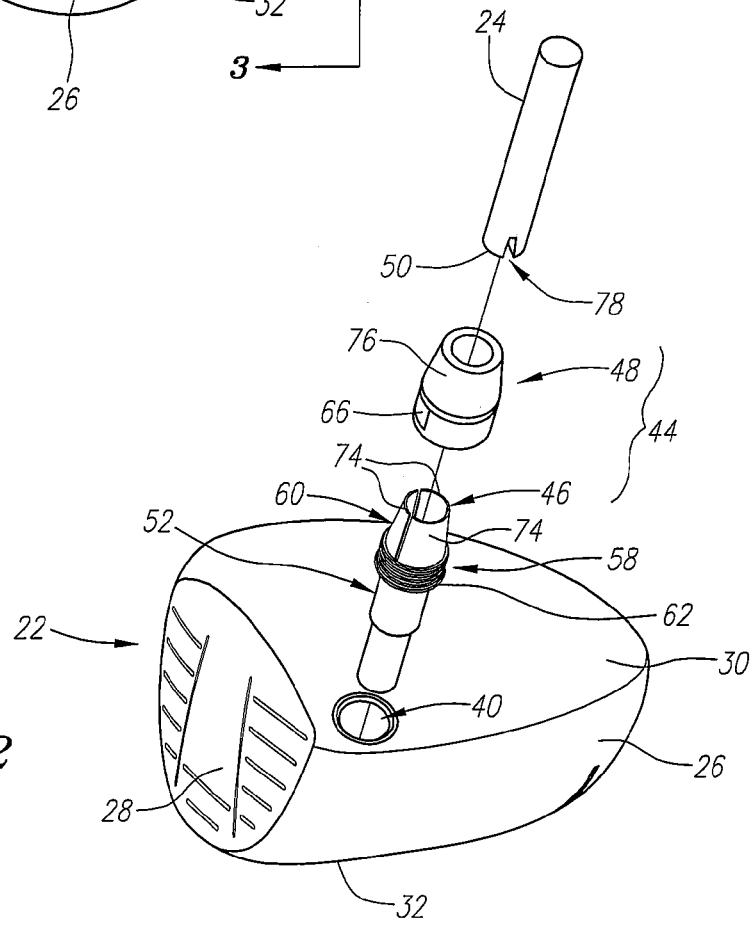
FIG. 2

FIG. 6
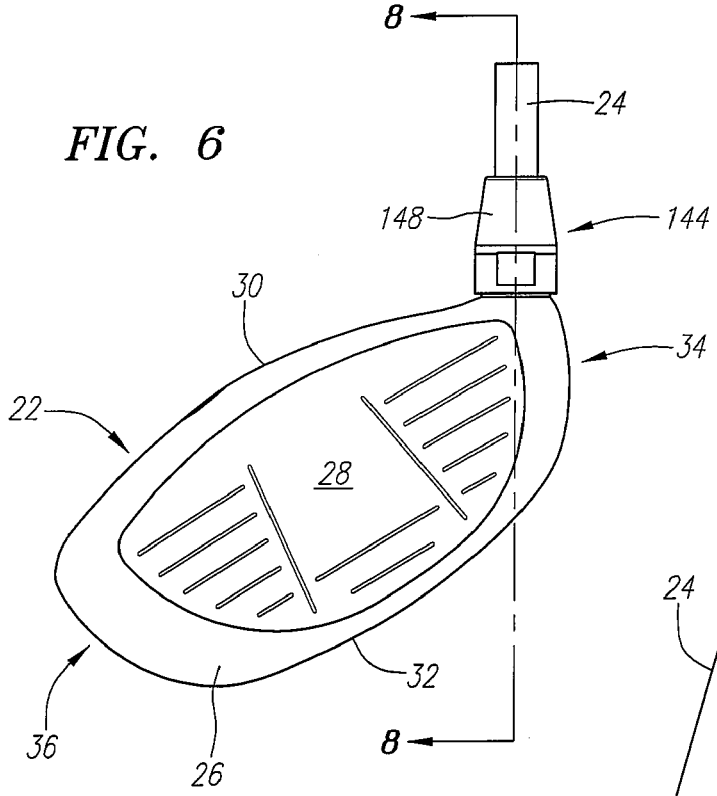
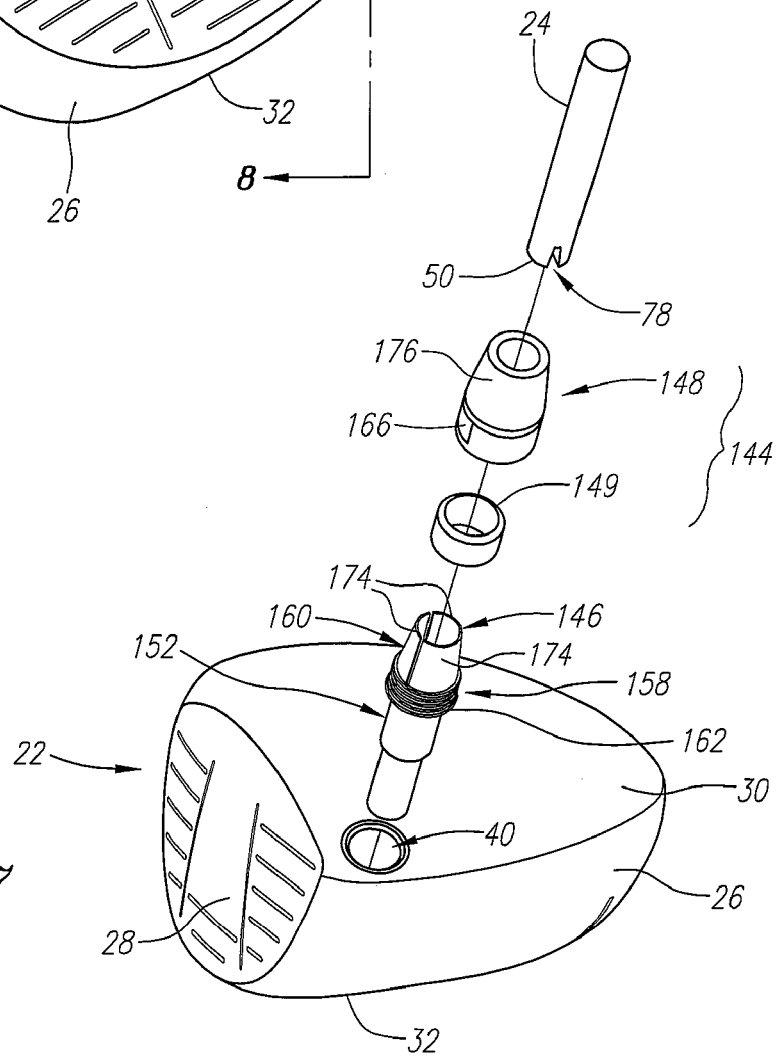
FIG. 7

| | Golf Club 20 with Connection 44 | Standard Golf Club Same Shaft and Club Head as Golf Club 20 |
|---|---|---|
| Mass (g) | 207.763848 | 207.263143 |
| Head Frame | | |
| CgX (in.) | 0.549019 | 0.550348 |
| CgY (in.) | 0.582579 | 0.596520 |
| CgZ (in.) | 1.169533 | 1.153910 |
| Ixx (g.cm$^2$) | 3227.178871 | 3169.285141 |
| Iyy (g.cm$^2$) | 2462.574837 | 2452.436507 |
| Izz (g.cm$^2$) | 4283.389553 | 4232.627803 |
| Iyz (g.cm$^2$) | 37.401192 | 71.447669 |
| Ixz (g.cm$^2$) | -92.997138 | -81.512224 |
| Ixy (g.cm$^2$) | 378.826981 | 368.571564 |
| Hosel Frame | | |
| CgX (in.) | -1.534762 | -1.555509 |
| CgY (in.) | 1.136975 | 1.139796 |
| CgZ (in.) | . -0.549019 | -0.550348 |
| Ixx (g.cm$^2$) | 3748.704575 | 3742.212978 |
| Iyy (g.cm$^2$) | 2997.259815 | 2942.851331 |
| Izz (g.cm$^2$) | 3227.178871 | 3169.285141 |
| Iyz (g.cm$^2$) | -262.058461 | -259.978618 |
| Ixz (g.cm$^2$) | 288.935481 | 273.679299 |
| Ixy (g.cm$^2$) | -830.104270 | -798.517546 |
| Face Frame | | |
| CgX (in.) | 1.145370 | 1.149918 |
| CgY (in.) | -0.169563 | -0.155622 |
| CgZ (in.) | 0.189240 | 0.174235 |

*FIG. 11*

METHOD FOR FITTING GOLF CLUBS TO A GOLFER

BACKGROUND OF THE INVENTION

1. Field of the Invention

The present invention relates to fitting golf clubs to a golfer.

2. Description of the Related Art

In order to improve their game, golfers often customize their equipment to fit their particular swing. Golf equipment manufacturers have responded by increasing the variety of clubs available to golfers. For example, a particular model of a driver-type golf club may be offered in several different loft angles and lie angles to suit a particular golfer's needs. In addition, golfers can choose shafts, whether metal or graphite, and adjust the length of the shaft to suit their swing. Golf clubs that allow shaft and club head components to be easily interchanged facilitate this customization process.

One example is Wheeler, U.S. Pat. No. 3,524,646 for a Golf Club Assembly. The Wheeler patent discloses a putter having a grip and a putter head, both of which are detachable from a shaft. Fastening members, provided on the upper and lower ends of the shaft, have internal threads, which engage the external threads provided on both the lower end of the grip and the upper end of the putter head shank to secure these components to the shaft. The lower portion of the shaft further includes a flange, which contacts the upper end of the putter head shank, when the putter head is coupled to the shaft.

Another example is Walker, U.S. Pat. No. 5,433,442 for Golf Clubs with Quick Release Heads. The Walker patent discloses a golf club in which the club head is secured to the shaft by a coupling rod and a quick release pin. The upper end of the coupling rod has external threads that and engage the internal threads formed in the lower portion of the shaft. The lower end of the coupling rod, which is inserted into the hosel of the club head, has diametric apertures that align with diametric apertures in the hosel to receive the quick release pin.

Still another example is Roark, U.S. Pat. No. 6,547,673 for an Interchangeable Golf Club Head and Adjustable Handle System. The Roark patent discloses a golf club with a quick release for detaching a club head from a shaft. The quick release is a two-piece connector including a lower connector, which is secured in the hosel of the club head, and an upper connector, which is secured in the lower portion of the shaft. The upper connector has a pin and a ball catch that protrude radially outward from the lower end of the upper connector. The upper end of the lower connector has a slot formed therein for receiving the upper connector pin, and a separate hole for receiving the ball catch. When the shaft is coupled to the club head, the lower connector hole retains the ball catch to secure the shaft to the club head.

U.S. Pat. No. 6,769,996 to Tseng discloses a Golf Club and a Method for Assembling the Golf Club. The golf club employs an externally threaded bolt to secure a shaft to the club head. The bolt, which is located inside the club head, extends through a threaded opening formed in a flange at a lower portion of the neck of the club head and engages a threaded lower end of the shaft. The bolt is accessed using a tool that is inserted in an opening formed in the sole of the club head. When the tool is extracted, the opening in the sole is plugged with a screw.

Two further examples are published applications to Burrows, U.S. Pub. Nos. 2004/0018886 and 2004/0018887, both of which are for a Temporary Golf Club Shaft-Component Connection. The Burrows applications disclose a temporary connection that includes an adapter insert, a socket member, and a mechanical fastener. The adapter insert, which is mounted on a shaft, includes a thrust flange. The socket member, which is mounted on the other golf club component (e.g., a club head), includes a thrust seat for seated reception of the thrust flange. The mechanical fastener (e.g., a compression nut or a lock bolt) removably interconnects the adapter insert and the socket member.

The prior art temporary head-shaft connections have several disadvantages. First, these connections typically add excessive weight to the club head, which affects the playability characteristics of the golf club. A change in the overall weight of a golf club alters the center of gravity and moments of inertias of the club head. Thus, a golf club with a shaft permanently affixed to a club head would have inherently different characteristics than a trial golf club that uses a prior art temporary connection to combine the same shaft and club head. Second, some of these connections require that the golf club head have a conventional hosel for attachment, while others require that a special head be made or that the club head be altered to accommodate the temporary connection. These changes can increase costs by requiring additional manpower, resources and inventory. Moreover, many of these prior art connections are cumbersome to use. Some designs require the connection device to be accessed from the bottom of the club head, others from the top, with different tools and procedures for each.

BRIEF SUMMARY OF THE INVENTION

One aspect of the present invention is a method of fitting a golf club to a golfer. The method begins with fitting a test golf club to a golfer. The test golf club has a preferred mass value and a preferred center of gravity position. Next, a final golf club is matched to the test golf club. The final golf club has a final mass within five grams of the preferred mass value of the test golf club and a center of gravity position within five percent of the equivalent position of the preferred position of the center of gravity of the test golf club.

Another aspect of the present invention is another method of fitting a golf club to a golfer. The method begins with fitting a test golf club to a golfer. The test golf club has a test golf club head and an interchangeable shaft placed within the test golf club head. The test golf club has a preferred mass value and a preferred location of mass. Next, a final golf club is matched to the test golf club. The final golf club has a final mass within five grams of the preferred mass value of the test golf club and a mass of the final golf club positioned within five percent of the equivalent position of the preferred location of mass of the test golf club.

Yet another aspect of the present invention is yet another method of fitting a golf club to a golfer. The method begins with fitting a test golf club to a golfer. The test golf club has a preferred mass value a preferred center of gravity location, a preferred volume, a preferred shape and a preferred plurality of inertial values. Next, a final golf club is matched to the test golf club. The final golf club has a final mass within five grams of the preferred mass value of the test golf club, a center of gravity position within five percent of the equivalent position of the preferred position of the center of gravity of the test golf club, a volume equal to the preferred volume of the test golf club, a shape equal to the preferred shape of the test golf club, and each of a plurality of inertial values is within five percent of each corresponding inertial value of the plurality of inertial values of the test golf club.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 1 is a front plan view of a test golf club utilized in accordance with the present invention.

FIG. 2 is an exploded heel perspective view of the golf club of FIG. 1 illustrating the components of the temporary head-shaft connection, including a sleeve and a mechanical fastener.

FIG. 6 is a front plan view of an alternative test golf club utilized in accordance with the present invention.

FIG. 7 is an exploded heel perspective view of the golf club of FIG. 6 illustrating the components of the temporary head-shaft connection, including a sleeve, a ring and a mechanical fastener.

FIG. 11 is a table comparing the mass properties of a test golf club and a standard production golf club.

DETAILED DESCRIPTION OF THE INVENTION

Figure 3:
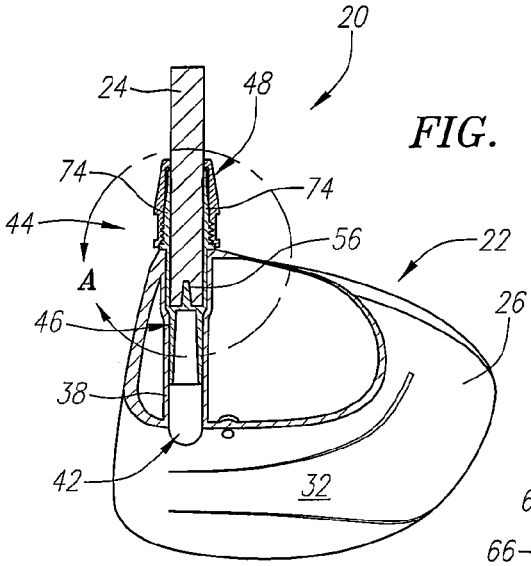
FIG. 3 is a cross-sectional view taken generally along the line 3-3 in FIG. 1.

As shown in FIGS. 1 and 2, a test golf club is generally designated 20. Test golf club 20 has a club head 22 and a shaft 24 that is coupled to club head 22. Club head 22 is preferably a wood-type golf club head, such as a driver, a fairway wood, or even a hybrid iron-wood-type club. Club head 22 includes a body 26 having a striking face 28, a crown portion 30, a sole portion 32, a heel end 34 and a toe end 36. Striking face 28 generally extends along the front of club head 22 from heel end 34 to toe end 36.

Body 26 is preferably composed of a metallic material, such as titanium, titanium alloy, stainless steel, or the like. Alternatively, body 26 may be composed of multiple materials, such as a titanium face cup attached to a carbon composite body, or a stainless steel body with a carbon composite crown. The body 26 preferably has volume ranging from 300 to 500 cubic centimeters, and more preferably from 420 to 460 cubic centimeters. Body 26 preferably has a hollow interior and includes an internal hosel 38 (FIG. 3) for receiving shaft 24. Internal hosel 38 preferably extends through the entire body 26 with an opening 40 in crown portion 30 and an opening 42 in sole portion 32. Alternatively, internal hosel 38 need not extend through sole portion 32 and, therefore, may not have opening 42 in sole portion 32. Furthermore, club head 22 may be provided with an external hosel (not shown) rather than an internal one.

Shaft 24 is preferably composed of a graphite material, however, it may be composed of a metallic material, such as stainless steel or titanium. Alternatively, shaft 24 may be composed of a hybrid of graphite and metal. Shaft 24 is coupled to club head 22 using a connection 44 that provides for easy assembly, disassembly and reassembly, thereby facilitating customization of golf club 20.

Figure 4:
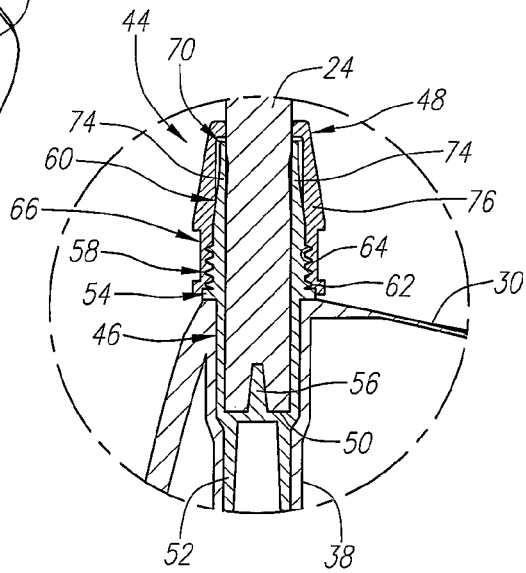
FIG. 4 is an enlarged cross-sectional view of circle A shown in FIG. 3.

In one embodiment of the invention illustrated in FIGS. 2-4, connection 44 includes a sleeve 46 and a mechanical fastener 48. Sleeve 46 is mounted in internal hosel 38 of club head 22 and preferably secured therein with an adhesive, such as epoxy. Mechanical fastener 48 is placed over a tip end 50 of shaft 40, and the tip end 50 is then into sleeve 46. Mechanical fastener 48 is secured to sleeve 46 to retain shaft 24 in connection with club head 22.

Figure 5A:
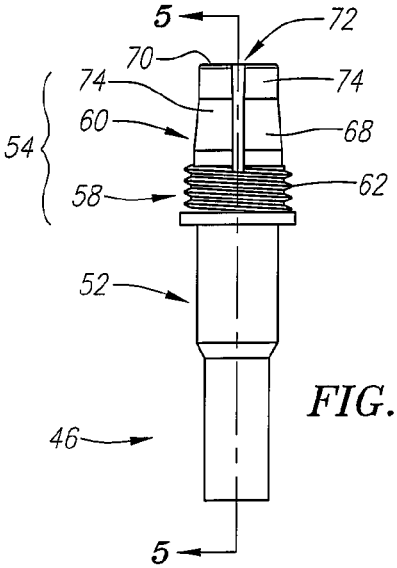
FIG. 5A is a plan view of the sleeve.
Figure 5B:
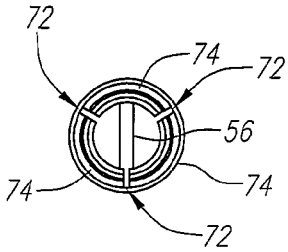
FIG. 5B is a top view of the sleeve shown in FIG. 5A.
Figure 5C:
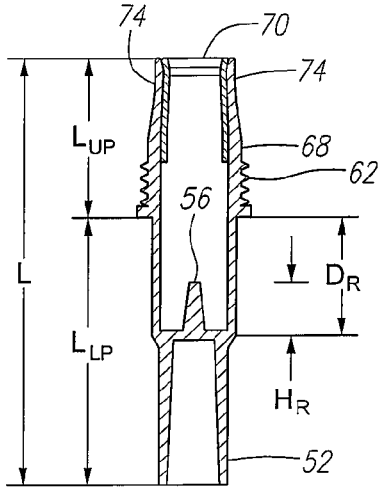
FIG. 5C is a cross-sectional view of the sleeve taken generally along line 5-5 in FIG. 5A.
Figure 8:
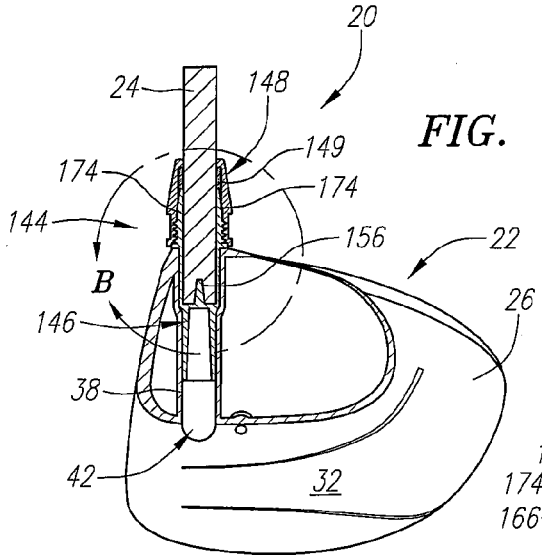
FIG. 8 is an enlarged cross-sectional view taken generally along the line 8-8 in FIG. 6.
Figure 9:
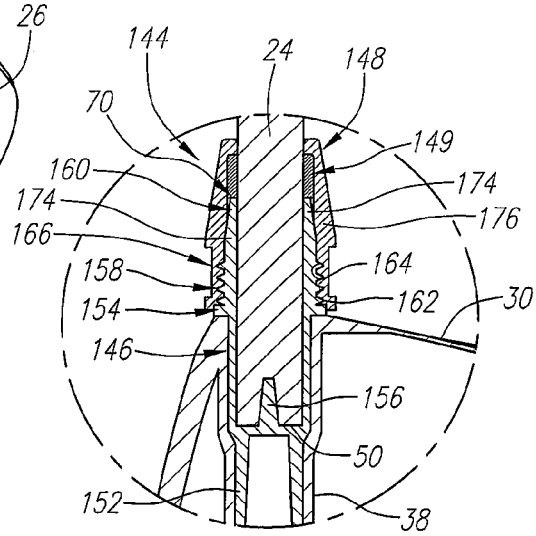
FIG. 9 is an enlarged cross-sectional view of circle B shown in FIG. 8.

As illustrated in FIGS. 5A-5C, sleeve 46 includes a lower portion 52 and an upper portion 54. Lower portion 52 is received in internal hosel 38 and thus has an outer configuration that is complementary to the interior configuration of internal hosel 38. Lower portion 52 of sleeve 46 preferably extends along a majority of the length of internal hosel 38 to stabilize sleeve 46 in internal hosel 38, as shown in FIG. 3. The dimensions of sleeve 46 may vary depending on the particular club head 22, however, one such sleeve 46 may have an overall length L of approximately 2.30 inches, with an upper portion length $L_{UP}$ of approximately 0.85 inch and a lower portion length $L_{LP}$ of approximately 1.45 inches.

Lower portion 52 of sleeve 46 further includes a rib 56 that extends diametrically across the interior of sleeve 46. Rib 56 preferably has a height $H_R$ of approximately 0.25 inch and a width in the range of 0.090 inch to 0.140 inch. The base of rib 56 is preferably located a distance $D_R$ of at least 0.5 inch from a top edge of lower portion 52 of sleeve 46.

Upper portion 54 of sleeve 46 projects from opening 40 in crown portion 30 of club head 22. Upper portion 54 includes a connection section 58 and a top section 60. Connection section 58 preferably includes external threads 62 for engagement with internal threads 64 that are provided on a connection section 66 of mechanical fastener 48. Alternatively, connection section 58 of upper portion 54 and connection section 66 of mechanical fastener 48 may have a tongue and groove fit or any other suitable mechanical attachment.

Top section 60 of upper portion 54 of sleeve 46 preferably has a frustoconical, collet configuration. Top section 60 tapers from a base 68 to an upper end 70 of sleeve 46. Thus, base 68 of top section 60 has an outer diameter that is larger than an outer diameter of upper end 70. A plurality of slits 72 are formed in top section 60 of sleeve 46. Each slit 72 preferably extends along the entire length of top section 60, from upper end 70 of sleeve 46 to connection section 58. Slits 72 divide top section 60 into a plurality of fingers 74. Top section 60 preferably includes three fingers 74 separated by three slits 72 (FIG. 5B), however, top section 60 may also be provided with as few as two fingers 74, or more than three fingers 74. Fingers 74, which are flexible, grasp shaft 24 when golf club 20 is fully assembled.

Mechanical fastener 48 includes a connection section 66 that is provided with internal threads 64, which mesh with external threads 62 of sleeve 46. Alternatively, the threads may be reversed, with connection section 66 of mechanical fastener 48 having external threads, connection section 58 of sleeve 46 having with internal threads, and mechanical fastener 48 being received in a portion of sleeve 46. In addition, as mentioned earlier, connection sections 58 and 66 may instead be provided with other engaging arrangements, such as a tongue and groove configuration.

Mechanical fastener 48 preferably has a height in the range of 0.90 inch and 1.0 inch. The exterior surface of mechanical fastener 48 may be provided with indentations (not shown) to receive a tool, such as a torque wrench, that would facilitate attachment of mechanical fastener 48 onto sleeve 46.

Mechanical fastener 48 further includes a tapered section 76. As internal threads 64 of mechanical fastener 48 mesh with external threads 62 of sleeve 46, tapered section 76 constricts fingers 74 to clamp around the circumference of shaft 24 and secure shaft 24 in place, much like a collet retains a work piece in a lathe.

Test golf club 20 is preferably assembled by inserting sleeve 46 into internal hosel 38 of club head 22. Lower portion 52 of sleeve 46 is preferably secured to internal hosel 38 using an adhesive, such as epoxy. A notch 78 is formed in tip end 50 of shaft 24 (FIG. 2). Notch 78 preferably has depth and width dimensions sufficient to accommodate the height and width of rib 56 in sleeve 46. Mechanical fastener 48 is placed over tip end 50 of shaft 24, and the tip end 50 of shaft 24 is then inserted into sleeve 46, which is mounted in internal hosel 38 of club head 22. Shaft 24 is inserted into sleeve 46 and rotated until notch 78 in shaft 24 connects with rib 56. Rib 56 prevents further rotation of shaft 24 relative to sleeve 46. Mechanical fastener 48 is then screwed onto sleeve 46, such that internal threads 64 of mechanical fastener 48 engage with external threads 62 of sleeve 46. As mechanical fastener 48 is tightened onto sleeve 46, tapered portion 76 of mechanical fastener 48 constricts fingers 74 of sleeve 46, such that fingers 74 clamp around the circumference of shaft 24 to retain shaft 24 in club head 22.

This temporarily assembled test golf club 20 may be disassembled by unscrewing mechanical fastener 48 from sleeve 46. With mechanical fastener 48 detached from sleeve 46, fingers 74 of sleeve 46 expand to release shaft 24, which may then be extracted from sleeve 46. A different shaft may then be removably attached to club head 22 using the same sleeve 46 and mechanical fastener 48.

Sleeve 46 and mechanical fastener 48 are each preferably composed of a strong, lightweight plastic material, such as a polycarbonate or urethane material. The plastic material may be impregnated with fiberglass or carbon fibers for increased strength. For example, sleeve 46 and mechanical fastener 48 may be composed of a twenty percent glass-filled polycarbonate plastic. The combined weight of the sleeve 46 and the mechanical fastener 48 connection is preferably in the range of 4 grams to 7 grams, more preferably between 5 grams and 6 grams, and most preferably approximately 5.5 grams.

Figure 12A:
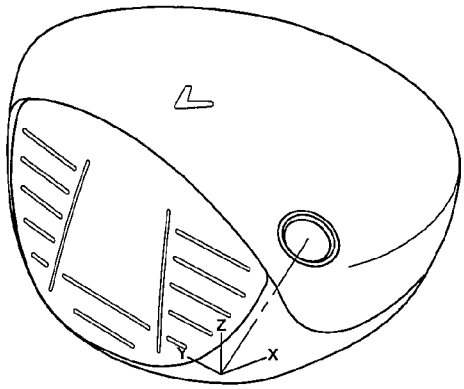
FIG. 12A is a front perspective view of a golf club illustrating the origin and the X, Y and Z-axes for head frame measurements.
Figure 12B:
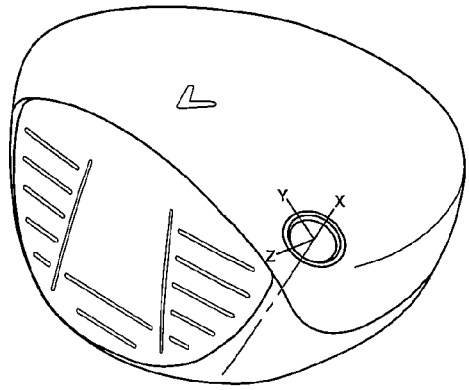
FIG. 12B is a front perspective view of a golf club illustrating the origin and the X, Y and Z-axes for hosel frame measurements.
Figure 12C:
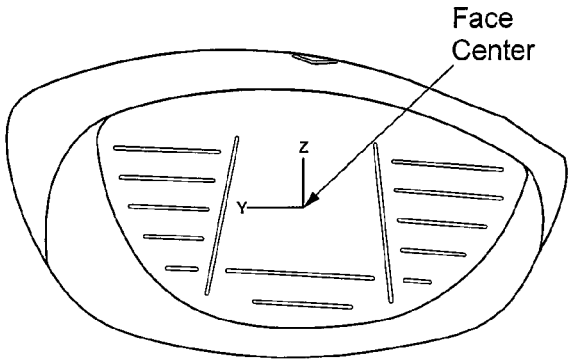
FIG. 12C is a front plan view of a golf club illustrating the origin and the Y and Z-axes for face frame measurements.
Figure 12D:
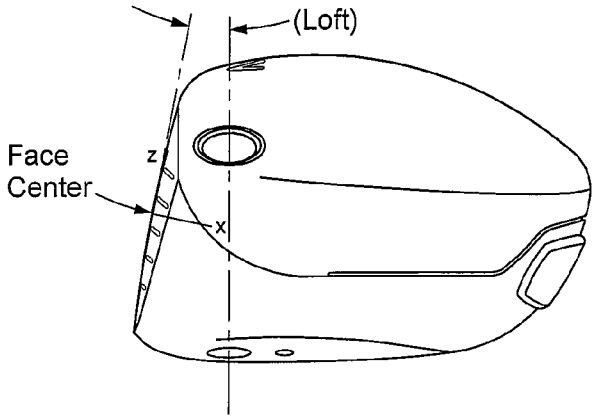
FIG. 12D is a heel plan view of the golf club illustrating the origin and the X and Y-axes for face frame measurements.

The test golf club utilized with the method of the present invention provides a temporary club head and shaft combination that has similar golf club characteristics to a standard production model of the same club head and shaft. The table provided in FIG. 11 compares the mass properties between a 10° driver with a shaft temporarily connected using connection 44 of the present invention and an identical 10° driver with an identical shaft permanently affixed in the internal hosel of a club head. FIGS. 12A-12D illustrate the origin and axes used for the head frame, hosel frame and face frame measurements, respectively. The origin is located at the intersection of the hosel's central axis and the ground plane for the head frame (FIG. 12A), at the top the hosel's central axis for the hosel frame (FIG. 12B), and at the face center of the club head for the face frame (FIGS. 12C and 12D).

The table in FIG. 11 shows that the difference in mass between the two golf clubs is slight, approximately 0.5 gram. In addition, the center of gravity location and the moments of inertia about each of the X, Y and Z-axes for the two golf clubs are very close. The similarities between the two golf clubs may be attributed to the lightweight plastic material that comprises connection 44 as well as to the sleeve design, which prevents shaft 24 from fully extending into internal hosel 38. Because only approximately 0.5 inch of shaft 24 extends into internal hosel 38, the mass of the resulting golf club 20 is about the same as the identical club head and shaft combination with the shaft fully inserted in and permanently attached to the hosel of the club head. The test golf club utilized with the present invention allows golfers to accurately test various club head and shaft combinations, since connection 44 does not adversely alter the playability of the golf club. Thus, golfers who swing golf club 20 will get an accurate feel of how a standard production golf club of that club head and shaft combination would play.

FIGS. 6-10C illustrate a test golf club with an alternative connection 144 for joining shaft 24 and club head 22. Connection 144 includes a sleeve 146, a mechanical fastener 148, and a ring 149. As with the prior embodiment, sleeve 146 is mounted in internal hosel 38 of club head 22, and mechanical fastener 148 is placed over tip end 50 of shaft 24. Prior to insertion of shaft 24 into sleeve 146, ring 149 is mounted on shaft 24 and affixed a predetermined distance from tip end 50 of shaft 24. Ring 149 provides additional assurance that shaft 24 will not separate from club head 22 when mechanical fastener 148 is secured to sleeve 146.

Figure 10A:
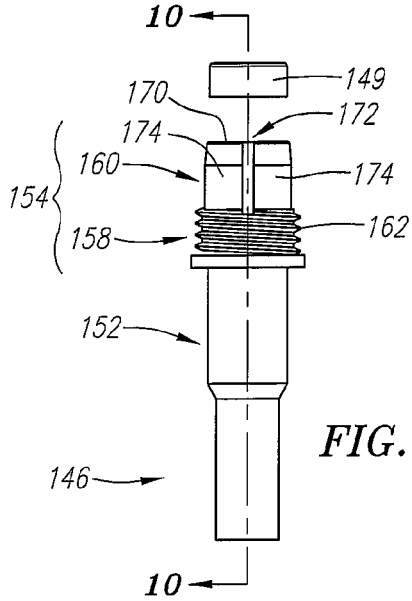
FIG. 10A is an exploded plan view of the sleeve and the ring.
Figure 10B:
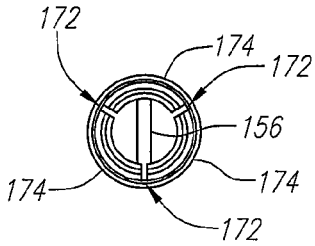
FIG. 10B is a top view of the sleeve and ring shown in FIG. 10A.
Figure 10C:
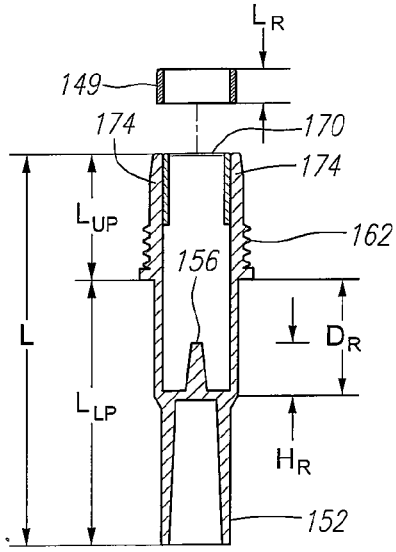
FIG. 10C is an exploded cross-sectional view of the sleeve and ring taken generally along the line 10-10 of FIG. 10A.

As illustrated in FIGS. 10A-10C, sleeve 146 includes a lower portion 152, which is received in internal hosel 38 of club head 22, and an upper portion 154. Because of ring 149, sleeve 146 is shorter in length than sleeve 46. By way of example, sleeve 146 may have an overall length L of approximately 2.10 inches, with an upper portion length $L_{UP}$ of approximately 0.67 inch and a lower portion length $L_{LP}$ of approximately 1.43 inches.

Lower portion 152 of sleeve 146 is similar in configuration to lower portion 52 of sleeve 46, and includes a rib 156 that extends diametrically across the interior of sleeve 146. The height and width of rib 156 are comparable to that of rib 56, and the base of rib 156 is preferably located a distance $D_R$ of approximately 0.6 inch from a top edge of lower portion 152 of sleeve 146.

Upper portion 154 of sleeve 146, which projects from opening 40 in crown portion 30 of club head 22, includes a connection section 158 and a top section 160. Connection section 158, like the earlier embodiment, includes external threads 162 for engagement with internal threads 164 that are provided on a connection section 166 of mechanical fastener 148. Top section 160 is truncated and has a slightly different configuration than top section 60 of sleeve 46. Top section 160 is generally cylindrical and has a plurality of slits 172 formed therein. Each slit 172 preferably extends along the entire length of top section 160 and divides top section 160 into a plurality of fingers 174. Top section 160 preferably includes three fingers 174 separated by three slits 172 (FIG. 10B). Fingers 174 are flexible and grasp shaft 24 when the test golf club is fully assembled.

Mechanical fastener 148 includes connection section 166, which is provided with internal threads 164, and a tapered section 176. Internal threads 164 mesh with external threads 162 of sleeve 146 to secure mechanical fastener 148 to sleeve 146. As mechanical fastener 148 is fastened onto sleeve 146, tapered section 176 of mechanical fastener 148 constricts fingers 174 of sleeve 146 to clamp around the circumference of shaft 24, thereby securing shaft 24 in club head 22.

Ring 149 is mounted on shaft 24 a predetermined distance $L_R$ from tip end 50 of shaft 24. Distance $L_R$ is preferably in the range of 1.27 inches and 1.29 inches. Ring 149 is secured onto shaft 24 using an adhesive, such as epoxy. With mechanical fastener 148 secured to sleeve 146, ring 149 prevents shaft 24 from slipping through fingers 174 and detaching from sleeve 146 and club head 22. Ring 149 may be approximately 0.25 inch in height and is preferably composed of the same lightweight plastic material as sleeve 146 and mechanical fastener 148 to maintain the overall weight of connection 144 in the range of 4 grams to 7 grams.

This embodiment of the test golf club is preferably assembled by inserting sleeve 146 into internal hosel 38 of club head 22 and securing sleeve 146 therein using an adhesive, such as epoxy. A notch 78 having dimensions sufficient to accommodate rib 156 in sleeve 146 is formed in tip end 50 of shaft 24. Mechanical fastener 148 and ring 149 are placed over tip end 50 of shaft 24. Ring 149 is affixed to shaft 24 at predetermined distance $L_R$ from tip end 50. The tip end 50 of shaft 24 is then inserted into sleeve 146, which is mounted in internal hosel 38 of club head 22. Shaft 24 is inserted and rotated until notch 78 in shaft 24 connects with rib 156. Rib 156 prevents further rotation of shaft 24. Mechanical fastener 148 is slid over ring 149 and then tightened onto sleeve 146, with internal threads 164 engaging external threads 162. Tapered portion 176 of mechanical fastener 148 constricts fingers 174 of sleeve 146, and fingers 174 clamp around the circumference of shaft 24. Fingers 174 and ring 149 cooperate to retain shaft 24 in sleeve 146 of club head 22. Ring 149 may also be employed to restrict axial rotation of shaft 24 within sleeve 146 after mechanical fastener 148 is tightened onto sleeve 146.

Disassembly of the test golf club is similar in process to the previous embodiment, however, ring 149 remains affixed to shaft 24.

Figure 13:
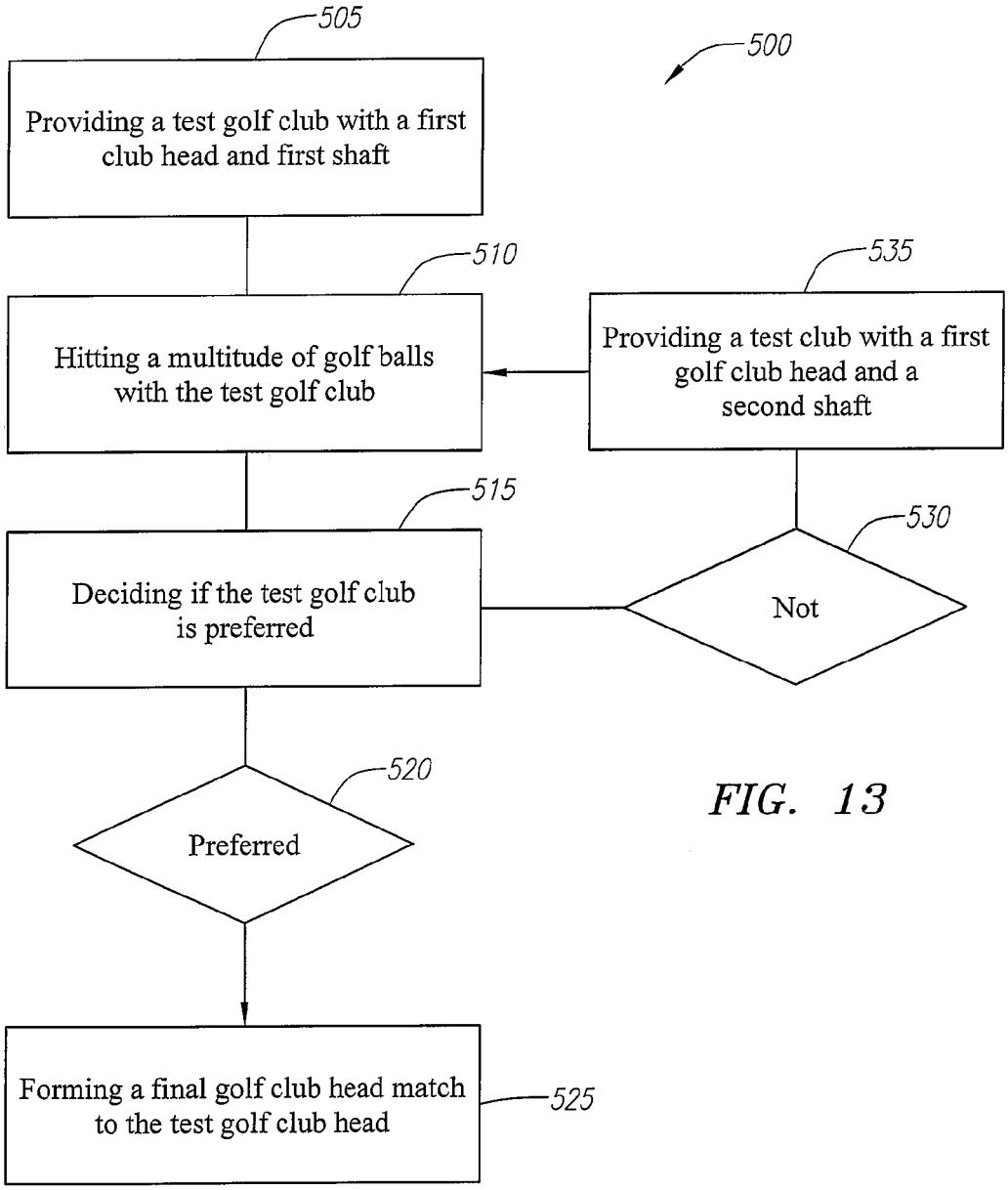
FIG. 13 is a flow chart of a general method of the present invention.

A general method 500 of the present invention is illustrated in FIG. 13. At block 505, a test golf club, such as described above, is provided to a golfer. The test golf club has a first club head and first shaft. At block 510, the golfer hits a multitude of golf balls with the test golf club. If the test golf club is a driver, the golfer will typically swing with maximum speed for every swing. If the test golf club is a iron, particularly a wedge, the golfer will swing at various speeds for each of the swings.

At block 515, the golfer decides if the test golf club is preferred. At block 520, if the test golf club is preferred, then at block 525 a final golf club is formed matching the test golf club. The final golf club matches the test golf club in any or all of the following parameters: volume, mass, mass location, inertial values, center of gravity location, material composition and shape. Preferably, the final golf club matches all of the parameters of the test golf club. Alternatively, the final golf club matches at least two of the parameters, more preferably at least three, even more preferably at least four of the parameters.

Returning to block 515, if the test club is not preferred at block 530, then at block 535 the golfer is provided a modified test golf club. Preferably, a second shaft is placed in a test golf club head of the test golf club. The second shaft is different then the first shaft. The second shaft is different from the first shaft for at least one of the following parameters: material composition, length, mass, mass location, flex, kickpoint, shape, thickness and color. Alternatively, a second golf club head is used with the first shaft. The second golf club head is different from the first golf club head for at least one of the following parameters: volume, mass, mass location, inertial values, center of gravity location, material composition, color and shape. The grip of the test golf club may also be modified.

With the modified test golf club, the golfer again hits a multitude of golf balls at block 510. At block 515, the golfer decides if the modified test golf club is preferred. If the modified test golf club is not preferred at block 530, at block 535 a second modified test golf is provided to the golfer. This process is repeated until a test golf club is preferred and a final golf club is formed for the golfer.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

What is claimed is:

1. A method of fitting a golf club to a golfer, the method comprising:

fitting a test golf club to a golfer, the test golf club comprising a test golf club head, a connection and an interchangeable shaft, the connection comprising a sleeve and a mechanical fastener for removably connecting the interchangeable shaft to the test golf club head, the connection composed of a polymer material and having a mass ranging from 4 grams to 7 grams, the sleeve of the connection secured within a hosel of the test golf club head and the mechanical fastener positioned about a tip end of the interchangeable shaft, the test golf club having a preferred mass value and a preferred location of mass, wherein the sleeve and the mechanical fastener are both composed of a polymer material and combined have a mass ranging from 4 grams to 7 grams;

matching a final golf club to the test golf club, the final golf club having a final mass within five grams of the preferred mass value of the test golf club and a mass of the final golf club positioned within five percent of the equivalent position of the preferred location of mass of the test golf club.

2. The method according to claim 1 wherein the preferred mass value of the test golf club comprises a preferred mass value of the interchangeable shaft with the mechanical fastener of the connection and a preferred mass value of the test golf club head with the sleeve of the connection, and the final golf club comprises a final golf club head with a final golf club head mass value and a final shaft with a final shaft mass value, wherein the final shaft mass value is within five weight percent of the preferred mass value of the interchangeable shaft and the final golf club head mass value is within five percent of the preferred mass value of the test golf club head.

3. The method according to claim 2 wherein the interchangeable shaft has a preferred location of mass and the test golf club head has a preferred location of mass, wherein a mass of the final shaft is positioned within five percent of the equivalent position of the preferred location of mass of the interchangeable shaft and a mass of the final golf club head is positioned within five percent of the equivalent position of the preferred location of mass of the test golf club head.

4. The method according to claim 2 wherein the test golf club further comprises a test grip placed on a butt end of the interchangeable shaft, the test grip having a preferred mass value and a preferred location of mass, and wherein the final golf club further comprises a final grip with a final grip mass value within five weight percent of the preferred mass value of the test grip and a mass of the final grip positioned within five percent of the equivalent position of the preferred location of a mass of the test grip.

5. The method according to claim 2 wherein each of the test golf head and the final golf club head is composed of a titanium alloy material.

6. The method according to claim 2 wherein each of the interchangeable shaft and the final shaft is composed of graphite.

7. The method according to claim 2 wherein each of the interchangeable shaft and the final shaft is composed of steel.

8. The method according to claim 2 wherein each of the test golf head and the final golf club head has a volume ranging from 300 cubic centimeters to 500 cubic centimeters.

9. The method according to claim 2 wherein each of the interchangeable shaft and the final shaft has a length ranging from 30 inches to 50 inches.

10. The method according to claim 2 wherein each of the test golf head and the final golf club head has a mass ranging from 175 grams to 250 grams.

11. The method according to claim 2 wherein each of the interchangeable shaft and the final shaft has a mass ranging from 10 grams to 50 grams.

* * * * *